US009705243B1

(12) United States Patent
McCracken et al.

(10) Patent No.: US 9,705,243 B1
(45) Date of Patent: Jul. 11, 2017

(54) ELECTRONIC CONNECTOR WITH C-SHAPED TAPERED EXTENSION

(71) Applicant: Microsoft Technology Licensing, LLC, Redmond, WA (US)

(72) Inventors: Ivan Andrew McCracken, Sammamish, WA (US); Hua Wang, Sammamish, WA (US); Jan Raken, Seattle, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 15/043,318

(22) Filed: Feb. 12, 2016

(51) Int. Cl.
*H01R 13/62* (2006.01)

(52) U.S. Cl.
CPC ..... *H01R 13/6205* (2013.01)

(58) Field of Classification Search
CPC ..... H01R 13/648; H01R 13/26; H01R 13/28; H01R 13/62; H01R 13/629; H01R 13/6205
USPC ..... 439/39, 660, 374
See application file for complete search history.

(56) References Cited

U.S. PATENT DOCUMENTS 2,749,526 A 6/1956 Petersen
3,264,601 A * 8/1966 Hartholz ..... H01R 13/26 439/660
3,553,633 A 1/1971 Ondrejka
3,696,319 A 10/1972 Olsson
3,703,615 A 11/1972 Vogt
4,179,179 A 12/1979 Lowden
4,421,371 A 12/1983 Clark et al.
(Continued)

FOREIGN PATENT DOCUMENTS

DE 4431280 C1 9/1994
EP 2169774 A1 3/2010
(Continued)

OTHER PUBLICATIONS

Ingle, P. et al., "Super Speed Data Traveller USB 3.0," International Journal of Computer Science and Applications, vol. 6, No. 2, Apr. 2013, 9 pages.

(Continued)

*Primary Examiner* — Harshad Patel
(74) *Attorney, Agent, or Firm* — Alleman, Hall Creasman & Tuttle LLP

(57) ABSTRACT

An electronic connector comprises a base, a tapered extension protruding from the base, and one or more magnets. The tapered extension includes a first connection face parallel with a first symmetry plane of the tapered extension, a first set of electrical contacts on the first connection face arranged symmetrically about a second, orthogonal symmetry plane of the tapered extension, a second connection face parallel with the first symmetry plane and facing the first connection face, and a second set of electrical contacts on the second connection face arranged symmetrically about the second symmetry plane. The tapered extension further includes first and second outer surfaces, first and second noses, and set of flank surfaces defining first and second sides of the tapered extension, where the first and second outer surfaces taper away from one another and the first and second sides taper away from one another toward the base.

20 Claims, 5 Drawing Sheets

(56) References Cited

U.S. PATENT DOCUMENTS

| | | | | |
|---|---|---|---|---|
| 4,537,459 | A | 8/1985 | Brennan et al. | |
| 4,640,570 | A | 2/1987 | Strate | |
| 4,687,267 | A | 8/1987 | Header et al. | |
| 4,824,383 | A | 4/1989 | Lemke | |
| 5,176,530 | A | 1/1993 | Reylek et al. | |
| 5,409,403 | A | 4/1995 | Falossi et al. | |
| RE35,508 | E | 5/1997 | Lemke et al. | |
| 5,664,953 | A | 9/1997 | Reylek | |
| 6,042,391 | A | 3/2000 | Bodo et al. | |
| 6,074,225 | A | 6/2000 | Wu et al. | |
| 6,280,209 | B1 | 8/2001 | Bassler et al. | |
| 6,322,372 | B1 * | 11/2001 | Sato | H01R 23/6873 439/65 |
| 6,565,363 | B2 | 5/2003 | Downing | |
| 6,786,755 | B2 | 9/2004 | Dambach et al. | |
| 7,331,793 | B2 | 2/2008 | Hernandez et al. | |
| 7,758,379 | B2 | 7/2010 | Chen | |
| 7,815,450 | B1 | 10/2010 | Chen et al. | |
| 7,837,499 | B1 | 11/2010 | Chen | |
| 7,841,776 | B2 | 11/2010 | DiFonzo et al. | |
| 8,092,261 | B2 | 1/2012 | Lord | |
| 8,147,277 | B1 | 4/2012 | Wang et al. | |
| 8,342,857 | B2 | 1/2013 | Palli et al. | |
| 8,506,332 | B2 | 8/2013 | Sommers et al. | |
| 8,596,881 | B2 | 12/2013 | Umeno | |
| 8,821,194 | B2 | 9/2014 | Shih et al. | |
| 8,911,260 | B2 | 12/2014 | Golko et al. | |
| 9,017,092 | B1 * | 4/2015 | McCracken | H01R 13/62 439/374 |
| 9,054,477 | B2 | 6/2015 | Brickner et al. | |
| 9,112,304 | B2 | 8/2015 | Rohrbach et al. | |
| 9,178,316 | B1 | 11/2015 | McCracken et al. | |
| 2001/0053624 | A1 | 12/2001 | Medina et al. | |
| 2004/0229502 | A1 | 11/2004 | Hu et al. | |
| 2009/0088024 | A1 | 4/2009 | Ling et al. | |
| 2009/0117784 | A1 | 5/2009 | Wu | |
| 2009/0318026 | A1 | 12/2009 | Yi et al. | |
| 2012/0015561 | A1 | 1/2012 | Tsai | |
| 2012/0177324 | A1 * | 7/2012 | Schwandt | G02B 6/4292 385/57 |
| 2012/0200173 | A1 | 8/2012 | Liu et al. | |
| 2013/0040470 | A1 | 2/2013 | Gao et al. | |
| 2013/0115814 | A1 | 5/2013 | Briant et al. | |
| 2013/0171885 | A1 | 7/2013 | Zhang | |
| 2013/0332642 | A1 | 12/2013 | Capezza | |
| 2014/0132550 | A1 | 5/2014 | McCracken et al. | |
| 2014/0254077 | A1 | 9/2014 | Griffin | |

FOREIGN PATENT DOCUMENTS

| | | | |
|---|---|---|---|
| JP | H04317899 | A | 11/1992 |
| WO | 2010065569 | A2 | 6/2010 |
| WO | 2011163260 | A1 | 12/2011 |
| WO | 2014164889 | A2 | 10/2014 |

OTHER PUBLICATIONS

Zhou, S. et al., "Signal Integrity Analysis of High-speed Signal Connector USB3.0," Advanced Materials Research, vol. 760-762, Sep. 18, 2013, 6 pages.

ISA European Patent Office, International Search Report and Written Opinion Issued in Application No. PCT/US2015/028681, Aug. 20, 2015, WIPO, 11 pages.

State Intellectual Property Office of the People's Republic of China, Notice of Allowance Issued in Chinese Patent Application No. 201210388564.8, Oct. 10, 2015, 4 pages.

Smith, Ryan., "USB Type-C: Charging Power, Display, & Data All in One", Published on: Apr. 14, 2015 Available at: http://www.anandtech.com/show/9136/the-2015-macbook-review/6.

Kim, Steven., "Magnector N10: Magnetic Pogo Charging Cable for Nexus 10", Retrieved on: Dec. 24, 2015 Available at: http://magnector.com/?p=3025&ckattempt=1.

"Magnetic USB", Retrieved on: Dec. 24, 2015 Available at: http://www.magnetic-usb.com/.

"ZNAPS", Retrieved on: Jan. 5, 2016 Available at: https://www.kickstarter.com/projects/1041610927/znaps-the-9-magnetic-adapter-for-your-mobile-devic/description.

* cited by examiner

1000

| PIN | | CONN. 100 | REC. 910 |
|---|---|---|---|
| P.1 | A1 | NC | GND |
| P.2 | A2 | NC | TX1+ |
| P.3 | A3 | NC | TX1- |
| P.4 | A4 | Vbus | Vbus |
| P.5 | A5 | CC | CC1 |
| P.6 | A6 | D+ | D+ |
| P.7 | A7 | D- | D- |
| P.8 | A8 | SBU1 | SBU1 |
| P.9 | A9 | Vbus | Vbus |
| P.10 | A10 | NC | RX2- |
| P.11 | A11 | NC | RX2+ |
| P.12 | A12 | NC | GND |
| P.13 | B1 | NC | GND |
| P.14 | B2 | NC | TX2+ |
| P.15 | B3 | NC | TX2- |
| P.16 | B4 | Vbus | Vbus |
| P.17 | B5 | Vconn | CC2 |
| P.18 | B6 | NC | D+ |
| P.19 | B7 | NC | D- |
| P.20 | B8 | SBU2 | SBU2 |
| P.21 | B9 | Vbus | Vbus |
| P.22 | B10 | NC | RX1- |
| P.23 | B11 | NC | RX1+ |
| P.24 | B12 | NC | GND |

FIG. 10

ELECTRONIC CONNECTOR WITH C-SHAPED TAPERED EXTENSION

BACKGROUND

Electronic devices often include hardware interfaces in the form of electronic connectors for exchanging electrical power, a ground reference, and/or communication signals with external systems.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

According to an embodiment of this disclosure, an electronic connector comprises a base and a tapered extension protruding from the base. The tapered extension includes a first connection face parallel with a first symmetry plane of the tapered extension, a first set of electrical contacts on the first connection face and arranged symmetrically about a second symmetry plane of the tapered extension that is orthogonal to the first symmetry plane, a second connection face parallel with the first symmetry plane of the tapered extension and facing the first connection face, and a second set of electrical contacts on the second connection face and arranged symmetrically about the second symmetry plane. The tapered extension further includes a first nose at an end of the first connection face distal from the base, a second nose at an end of the second connection face distal from the base, a first outer surface extending from the first nose towards the base, and a second outer surface extending from the second nose towards the base. A tapering portion of the first outer surface and a tapering portion of the second outer surface taper away from one another towards the base symmetrically about the first symmetry plane.

The tapered extension further includes a first flank surface between the first connection face and the first outer surface at a first side of the tapered extension, and a second flank surface between the first connection face and the first outer surface at a second side of the tapered extension. A portion of the first flank surface and a portion of the second flank surface taper away from one another towards the base symmetrically about the second symmetry plane. The tapered extension further includes a third flank surface between the second connection face and the second outer surface at the first side of the tapered extension, and a fourth flank surface between the second connection face and the second outer surface at the second side of the tapered extension. A portion of the third flank surface and a portion of the fourth flank surface taper away from one another towards the base symmetrically about the second symmetry plane.

The electronic connector further includes a first magnet within the base and spaced a first distance from the second symmetry plane on a first side of the second symmetry plane, and a second magnet within the base and spaced the first distance from the second symmetry plane on a second side of the second symmetry plane, different than the first side of the second symmetry plane.

BRIEF DESCRIPTION OF THE DRAWINGS

FIG. 10 is a table depicting example pin-out configurations for an electronic connector and receptacle.

DETAILED DESCRIPTION

Figure 1:
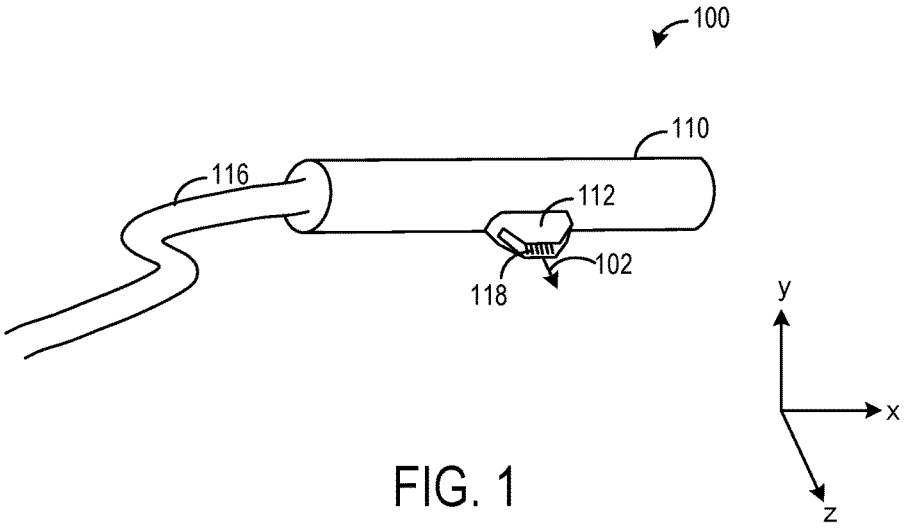
FIG. 1 depicts an example electronic connector.

Paired electronic connectors may include a male electronic connector having an extension that projects outward and a corresponding female electronic connector having a receptacle that accommodates the extension. Connection may be made between respective electrical contacts when the male connector is inserted into the female connector, in order to transfer data, power, and/or other signals between the connectors.

To enhance user satisfaction with paired electronic connectors and/or reduce potential damage to the paired connectors, some paired electronic connectors may be configured to be reversibly-inserted such that a male electronic connector can be inserted in multiple orientations into a receptacle. However, the electrical contact configuration of such connectors may dictate that the male connector be large, require electromagnetic shielding, and/or have other configurations that may prevent the male connector from being self-aligning.

As described below, a male electronic connector may be tapered along multiple axes and include magnetic elements to enable self-alignment in multiple orientations. The connector described herein may be configured to interface with a standard universal serial bus (USB) TYPE-C receptacle, thus enabling the connector to be used with a variety of existing devices. A magnetic quick connect and detach of the USB TYPE-C plug may improve the user experience by enabling lower effort during attach and protection against breakage in the event of inadvertent cord pull.

The connector described herein allows for power and USB 2.0 (12 or 480 Mbps data) through the connector plug and cable. The described connector does not include the super-speed signal lanes of typical USB TYPE-C implementations. As such, the plug need not include typical USB TYPE-C EMI shielding. As a result, the length of the plug is less than the length of a typical USB TYPE-C plug. The resulting shorter plug facilitates an easy plug attach/detach. It may be appreciated that other signaling rates are possible, but at higher frequencies the EMI may become an issue.

Further, the outer six signal contacts on each side of a conventional USB TYPE-C plug are not present, and the plug is tapered where such contacts would otherwise be located. The taper also facilitates an easy plug attach/detach. A relatively short plug that is tapered is thought to deliver an enhanced user experience when compared to a conventional USB TYPE-C plug. A longer plug or less taper, for example, would result in a lower likelihood of magnetic attach without tedious user alignment. Side detent springs of typical USB TYPE-C plugs are also not included, thus eliminating the positive attach force required in a standard USB TYPE-C connector. Instead, the magnets serve to hold the plug to the receptacle. Additionally, the described shape allows for a low-friction detach in the event of an inadvertent or intentional quick disconnect.

Thus, as described in more detail below, a paired electronic connector may include a male electronic connector having a tapered extension that projects outward along a connection axis, and a corresponding female electronic connector having a receptacle that accommodates the tapered extension. The tapered extension may be self-aligning within the receptacle, thereby providing an improved user experience for establishing an electrical connection between the paired electronic connectors.

Magnetically attractable elements optionally may be incorporated into the paired electronic connectors to further assist with the alignment and connection of male and female electronic connectors.

When a taper is employed, the leading profile area of the plug of the male electronic connector is smaller than an opening of the female electronic connector. This size difference creates a relatively large attachment tolerance that can make it easier to insert the male electronic connector into the female electronic connector. Furthermore, the magnetically attractable elements help the connection come together with very little effort. The taper and the magnetic nature of the connection can provide a sensation of the male and female electronic connectors flying together.

The paired electronic connectors and associated electronic control circuitry may support two orientations, which may further improve user experience for establishing an electrical connection because the user may insert the male connector with different orientations without stopping to consider which orientation is correct.

FIGS. 1-6 depict an example electronic connector 100 having a first configuration. Electronic connector 100 includes a base 110 and a tapered extension 112 that protrudes from base 110 along a connection axis 102 (i.e., Z axis). Electronic connector 100 may include or interface with a connector cable 116 that includes one or more electrically conductive wires for transmitting electrical power, ground, and/or electrical signals to and/or from a set of electrical contacts 118. In other configurations, base 110 of electronic connector 100 may be integrated with or take the form of a chassis or body of an electronic device or docking station.

Electronic connector 100 may take the form of a male electronic connector that is configured, for example, to interface with a corresponding female electronic connector to form one or more electrical connections across the set of electrical contacts 118. As one example, electronic connector 100 may be mated to or unmated from another corresponding electronic connector (e.g., receptacle 910 of FIG. 9) along connection axis 102. The female electronic connector may take the form of a typical female USB TYPE-C connector, as one example.

Connection axis 102 is parallel to the Z-coordinate axis of the three-dimensional Cartesian coordinate system depicted in FIG. 1. As such, electronic connector 100 may be connected to another corresponding female electronic connector by moving electronic connector 100 in the positive Z direction. Electronic connector 100 may be disconnected by withdrawing electronic connector 100 relative to the other electronic connector in the negative Z direction.

Tapered extension 112 of electronic connector 100 may be substantially c-shaped, including an opening defined by two inner connection faces (described in more detail below). The set of electrical contacts 118 may be positioned on interior connection faces that form the opening of the c-shaped tapered extension 112.

Figure 2:
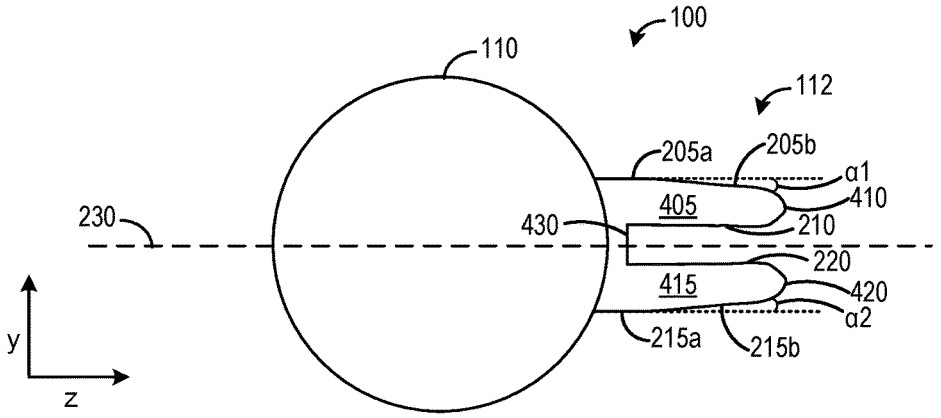
FIG. 2 is a first side view of the example electronic connector of FIG. 1 viewed along the X-coordinate axis.
Figure 3:
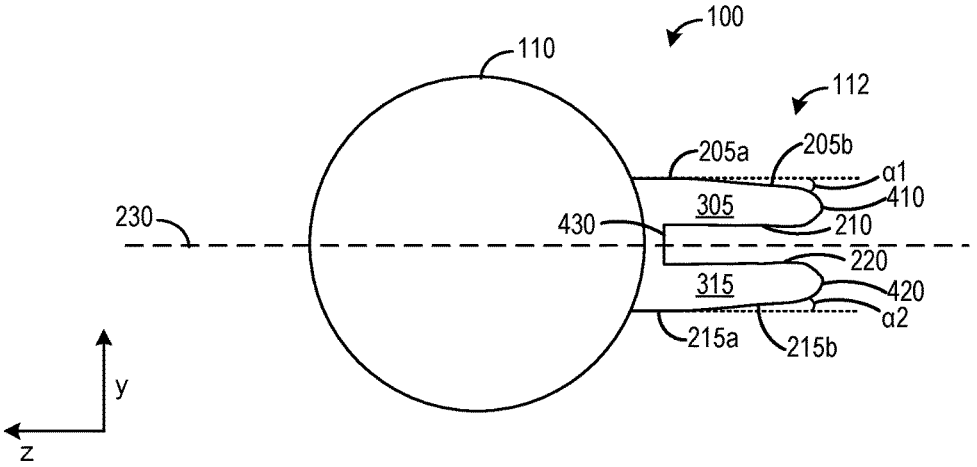
FIG. 3 is a second side view of the example electronic connector of FIG. 1 viewed along the X-coordinate axis.

FIG. 2 is a first side view of the example electronic connector 100 of FIG. 1 viewed along the X-coordinate axis. FIG. 3 is a second side view of the example electronic connector 100 of FIG. 1 viewed along the X-coordinate axis. FIGS. 2 and 3 will be described collectively herein. Tapered extension 112 is substantially c-shaped and includes an opening defined by a first connection face 210, a second connection face 220 facing first connection face 210, and a back surface 430 connecting first connection face 210 to second connection face 220. First connection face 210 and second connection face 220 are arranged parallel relative to each other and parallel to a first symmetry plane 230 that is parallel to or co-planar with an XZ-coordinate plane. In an example, connection axis 102 is parallel to and contained within first symmetry plane 230. Back surface 430 is perpendicular to first connection face 210 and second connection face 220, and first symmetry plane 230 bisects back surface 430.

Tapered extension 112 terminates at two noses, a first nose 410 at an end of the first connection face 210 distal from the base 110 and a second nose 420 at an end of the second connection face 220 distal from base 110. In at least some configurations, an edge profile of first nose 410 and an edge profile of second nose 420, if viewed along the X-coordinate axis, may take the form of a semi-circle that interfaces with first connection face 210 and second connection face 220. A semi-circle of the nose may have a constant radius or may take other suitable forms. The nose may alternatively have a curved but non-circular edge profile, a polygonal edge profile, a pointed edge profile or triangular terminal end, or any other edge profile.

First connection face 210 extends outward from back surface 430 to first nose 410. Second connection face 220 extends outward from back surface 430 to second nose 420. Each of first connection face 210 and second connection face 220 may include one or more electrical contacts of the set of electrical contacts 118 of FIG. 1. Additional detail regarding the electrical contacts will be presented below with respect to FIGS. 5 and 6.

Tapered extension 112 further includes a first outer surface 205, opposite the first connection face 210, and a second outer surface 215, opposite the second connection face 220. First outer surface 205 terminates at first nose 410 and second outer surface 215 terminates at second nose 420.

At least a portion of first outer surface 205 and at least a portion of second outer surface 215 may taper away from each other along first symmetry plane 230 from the first nose 410 and the second nose 420 toward base 110. As shown in FIGS. 2 and 3, the first outer surface 205 includes a tapering portion **205*b* and a non-tapering portion 205*a* intermediate base 110 and tapering portion 205***b*. Tapering portion 205*b* tapers inward from non-tapering portion 205*a* toward first nose 410. The second outer surface 215 includes a tapering portion 215*b* and a non-tapering portion 215*a* intermediate base 110 and tapering portion 215*b*. Tapering portion 215*b* tapers inward from non-tapering portion 215*a* toward second nose 420.

First outer surface 205 and second outer surface 215 may taper away from each other symmetrically along first symmetry plane 230. As such, a magnitude of each taper angle relative to a particular reference may be identical for both outer surfaces. Therefore, a magnitude of a first taper angle $\alpha 1$ is equal to a magnitude of a second taper angle $\alpha 2$ in the example depicted in FIG. 2.

As an example, first taper angle $\alpha 1$ and second taper angle $\alpha 2$ may have a magnitude that is selected from the range 1 degree-10 degrees. In still further examples, first taper angle $\alpha 1$ and second taper angle $\alpha 2$ may have a magnitude that is selected from the range >0 degrees-45 degrees. In at least some use-scenarios, a smaller taper angle relative to the connection axis may advantageously provide greater connection depth and/or connector retention by a female connector, while a larger taper angle relative to the connection axis may advantageously reduce connector depth and/or assist in connector mating with a female connector. A lesser taper angle may also allow for a relatively smaller opening in the Y dimension of a corresponding female connector, thus increasing options for small device size and/or female connector placement. Additionally, less tapering may allow for a sturdier or more robust tapered extension.

A tapered extension may include first and second outer surfaces having other suitable taper angles. In other configurations, for example, first and second outer surfaces may be inclined relative to each other, but may have taper angles of different magnitudes relative to a common reference (i.e., asymmetrical tapers). Further, in some examples, an entirety of first outer surface and/or second outer surface may taper, from the base to each respective nose.

Tapered extension 112 further includes a set of flank surfaces. Each flank surface connects a respective connection face to a corresponding outer surface on a respective side of the tapered extension. As shown in FIG. 2 a first flank surface 405 connects first connection face 210 to first outer surface 205 on a first side of the tapered extension. A third flank surface 415 connects second connection face 220 to second outer surface 215 on the first side of the tapered extension. FIG. 3 shows similar flank surfaces are present on a second, opposite side of the tapered extension including a second flank surface 305 that connects first connection face 210 to first outer surface 205 and a fourth flank surface 315 that connects second connection face 220 to second outer surface 215 on the second side of the tapered extension. The first flank surface and the third flank surface may be at least partially separated by the opening of the c-shaped tapered extension, and the second flank surface and fourth flank surface may be at least partially separated by the opening of the c-shaped tapered extension.

First flank surface 405 and second flank surface 305 form respective opposing sides of tapered extension 112 between first connection face 210 and first outer surface 205. As one example, first flank surface 420 and second flank surface 305 have curved outward facing edge profiles as viewed along the Z-coordinate axis, and have straight or flat outward facing edge profiles as viewed along the Y-coordinate axis. Likewise, third flank surface 415 and fourth flank surface 315 form respective opposing sides of tapered extension 112 between second connection face 220 and second outer surface 215. As one example, third flank surface 415 and fourth flank surface 315 have curved outward facing edge profiles as viewed along the Z-coordinate axis, and have straight or flat outward facing edge profiles as viewed along the Y-coordinate axis. In other configurations, flank surfaces may have curved and/or multi-faced edge profiles as viewed along the Y-coordinate axis, straight or multi-faced edge profiles as viewed along the Z-coordinate axis, and/or different edge profiles relative to each other.

Figure 4:
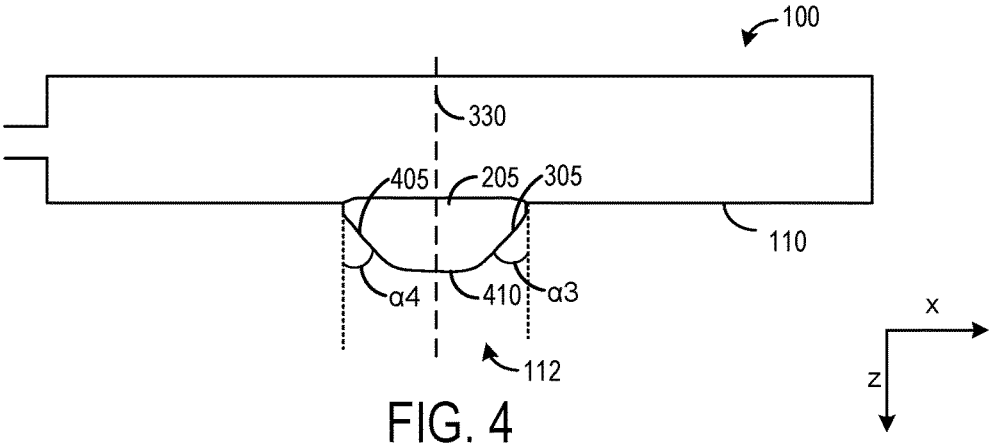
FIG. 4 is a top view of the example electronic connector of FIG. 1 viewed along the Y-coordinate axis.

FIG. 4 is a top view of the example electronic connector 100 of FIG. 1 viewed along the Y-coordinate axis. In the depicted configuration, first flank surface 405 and second flank surface 305 are symmetric about a second symmetry plane 330 that is orthogonal to first symmetry plane 230. In this example, second symmetry plane 330 bisects first connection face 210, second connection face 220, first outer surface 205, and second outer surface 215. At least a portion of the first flank surface 405 and a portion of the second flank surface 305 taper away from one another from first nose 410 towards base 110 symmetrically about the second symmetry plane.

As such, a magnitude of each flank surface taper angle relative to a particular reference may be identical for both the first flank surface and second flank surface. Therefore, a magnitude of a third taper angle $\alpha 3$ is equal to a magnitude of a fourth taper angle $\alpha 4$ in the example depicted in FIG. 4.

As an example, third taper angle $\alpha 3$ and fourth taper angle $\alpha 4$ may have a magnitude that is selected from the range 1 degree-45 degrees. In still further examples, third taper angle $\alpha 3$ and fourth taper angle $\alpha 4$ may have a magnitude that is selected from the range >0 degrees-60 degrees.

A tapered extension may include first and second flank surfaces having other suitable taper angles. In other configurations, for example, first and second flank surfaces may be inclined relative to each other, but may have taper angles of different magnitudes relative to a common reference (i.e., asymmetrical tapers). Further, in some examples, an entirety of first flank surface and/or second flank surface may taper, from the base the nose.

Figure 5:
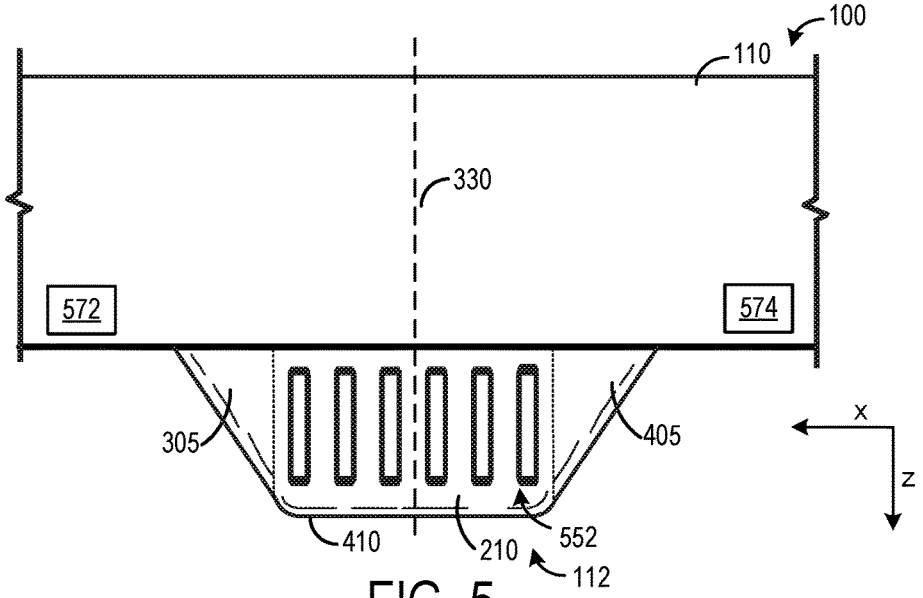
FIG. 5 is a first transverse pseudo cross-section view of the example electronic connector of FIG. 1 viewed along the Y-coordinate axis.
Figure 6:
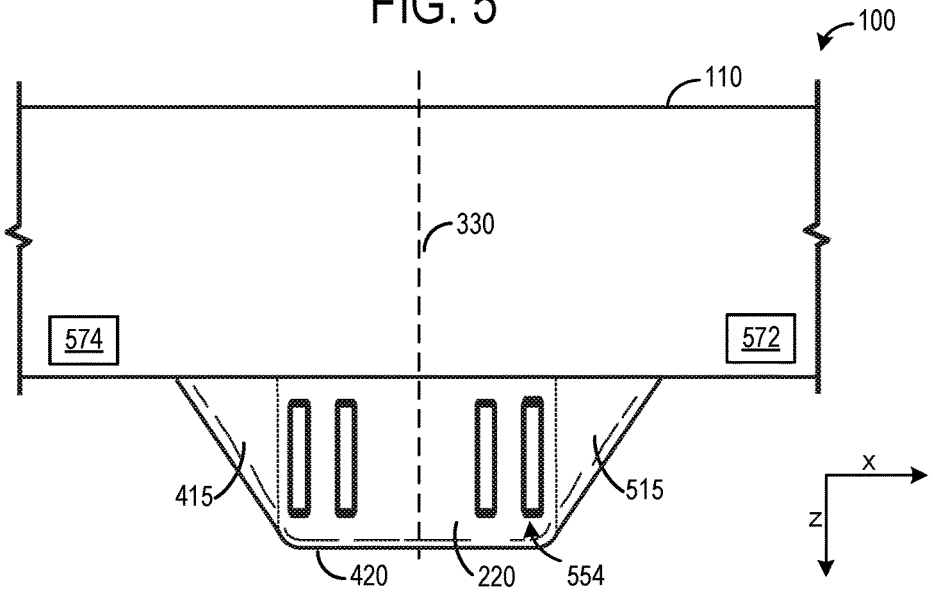
FIG. 6 is a second transverse pseudo cross-section view of the example electronic connector of FIG. 1 viewed along the Y-coordinate axis.

FIGS. 5 and 6 schematically show the electronic connector 100 of FIG. 1 taken in pseudo-cross-section along the first symmetry plane 230. FIG. 5 shows a view of a top inner side of the tapered extension along the Y-coordinate axis. FIG. 6 shows a view of a bottom inner side of the tapered extension along the Y-coordinate axis.

As shown in FIG. 5, tapered extension 112 includes first connection face 210 terminating at first nose 410. First connection face 210 connects to first flank surface 405 and second flank surface 305. Second symmetry plane 330 bisects tapered extension 112.

As shown in FIG. 6, tapered extension 112 includes second connection face 220 terminating at second nose 420. Second connection face 220 connects to third flank surface 415 and fourth flank surface 315. Second symmetry plane 330 bisects tapered extension 112.

FIGS. 5 and 6 further depict a configuration in which the set of electrical contacts 118 of electronic connector 100 is divided into a first subset of electrical contacts 552 located along first connection face 210, and a second subset of electrical contacts 554 located along second connection face 220. The arrangement of electrical contacts depicted in FIGS. 5 and 6 is an example of an electrical contact configuration for an electronic connector. Other suitable electrical contact configurations may be used.

The first and second subsets of electrical contacts may include any suitable quantity of electrical contacts. As one example, each connection face may include six or less, eight, ten, twelve, fourteen, sixteen, eighteen, twenty, or even greater quantities of electrical contacts. Symmetrical configurations will generally include an even number of electrical contacts, although symmetrical configurations may include an odd number of electrical contacts with a centered contact. Asymmetrical even and odd number configurations are within the scope of this disclosure and may provide a mechanism for detecting male connector orientation. In at least some configurations, the first and second subsets of electrical contacts may each have the same quantity of electrical contacts.

FIGS. 5 and 6 depict an example in which the first subset of electrical contacts 552 includes six electrical contacts, and the second subset of electrical contacts 554 includes four electrical contacts. In another configuration, a first set of electrical contacts may include six electrical contacts and a second set of electrical contacts may also include six electrical contacts.

In other configurations, first and second subsets of electrical contacts may have different quantities of electrical contacts relative to each other. As one example, a first subset of electrical contacts located along a first connection face may include two or more electrical contacts, and a second subset of electrical contacts located along a second connection face may include fewer electrical contacts than the first subset of electrical contacts. In at least some configurations, the second subset of electrical contacts may be omitted, for example, so that zero electrical contacts are located along second connection face 220.

In at least some configurations, outward facing surfaces of the first subset of electrical contacts 552 protrude outward relative first connection face 210, and outward facing surfaces of the second subset of electrical contacts 554 protrude outward relative to second connection face 220. The first subset of electrical contacts 552 and the second subset of electrical contacts 554 may include springs to resiliently bias the outward facing surfaces. In one example, the outward facing surfaces of the first subset of electrical contacts 552 may protrude outward relative first connection face 210 by an amount in a range of 0.15-0.35 mm, and outward facing surfaces of the second subset of electrical contacts 554 may protrude outward relative to second connection face 220 by an amount in a range of 0.15-0.35 mm, although other amounts are possible.

In other configurations, outward facing surfaces of the first subset of electrical contacts 552 may be flush with first connection face 210, and outward facing surfaces of the second subset of electrical contacts 554 may be flush with second connection face 220. Flush connection faces may provide smooth insertion of the electronic connector into a receptacle or withdrawal of the electronic connector from the receptacle. Flush connection faces may also improve connector cleanliness and facilitate connector cleaning. Such cleaning may be manual or due to, for example, friction during insertion and withdrawal. In such configurations, the electrical contacts of a corresponding receptacle may protrude outward relative a respective surface of the receptacle. In other configurations, outward facing surfaces of electrical contacts may be recessed relative to the first and second connection faces.

Electrical contacts may have any suitable shape and/or size. In the example depicted in FIGS. 5 and 6, externally facing connection surfaces of the electrical contacts have a flat rectangular shape. However, an externally facing connection surface of an electrical contact may have other suitable shapes, including circles, ovals, multi-sided two-dimensional shapes, multi-sided three-dimensional shapes, etc. The electrical contacts depicted in FIGS. 5 and 6 are of similar shape and size in relation to each other. In other configurations, electrical contacts of an electronic connector may have different shapes and/or sizes in relation to each other.

In at least some configurations, the first subset of electrical contacts 552 may be evenly spaced apart from each other along the first connection face 210 as measured along the X-coordinate axis. The first subset of electrical contacts 552 may be positioned symmetrically with respect to second symmetry plane 330. As such, at least one electrical contact of the first subset of electrical contacts 552 may be positioned on a first side of second symmetry plane 330 at a first distance from second symmetry plane, while at least one other electrical contact of the first subset of electrical contacts 552 may be positioned on a second side of second symmetry plane, at the first distance from second symmetry plane 330.

In a further example, two middle electrical contacts along first connection face 210 may be equally spaced from second symmetry plane 330, the outer electrical contacts along first connection face 210 may be equally spaced from second symmetry plane 330, and other intermediate electrical contacts along first connection face may be paired with a symmetric electrical contact located on an opposite side of second symmetry plane 330 that is equally spaced from second symmetry plane 330.

In at least some configurations, the first subset of electrical contacts 552 are arranged symmetrically along first connection face 210 about second symmetry plane 330. In the example depicted in FIG. 5, second symmetry plane 330 is orthogonal to first symmetry plane 230 and is parallel to or coplanar with the YZ-coordinate plane. In the example depicted in FIG. 5, three electrical contacts (or half of electrical contacts 552) are located along first connection face 210 on one side of second symmetry plane 330, and another three electrical contacts (or half of electrical contacts 552) are located along first connection face 210 on an opposite side of second symmetry plane 330. In other configurations, a different quantity of electrical contacts may be located along first connection face 210 on either side of symmetry plane 330 in a symmetric or asymmetric arrangement.

As shown, the second subset of electrical contacts 554 may be positioned similarly to the first subset of electrical contacts 552, in that the second subset of electrical contacts 554 may be positioned symmetrically about second symmetry plane 330. As shown, the two middle electrical contacts that are present in first subset of electrical contacts 552 are not present in second set of electrical contacts 554.

Thus, the second subset of electrical contacts 554 may also be arranged symmetrically along second connection face 220 about second symmetry plane 330. In the example depicted in FIG. 6, two electrical contacts (or half of electrical contacts 554) are located along second connection face 220 on one side of second symmetry plane 330, and another two electrical contacts (or half of electrical contacts 554) are located along second connection face 220 on an opposite side of second symmetry plane 330.

In other configurations, electrical contacts may not be evenly spaced apart from each other along first and/or second connection faces to provide any number of symmetric or asymmetric contact configurations.

FIGS. 5 and 6 depict each electrical contact of the second subset of electrical contacts 554 being aligned with a corresponding electrical contact of the first subset of electrical contacts 552 along the X-coordinate axis. In some configurations, one of the connection faces may not include any electrical contacts.

FIGS. 5 and 6 further depict an example in which the electrical contacts are aligned with one another between flank surfaces. For example, first subset of electrical contacts 552 has a straight-line alignment along first connection face 210 that is parallel to the terminal end of the tapered extension formed by first nose 410. In this example, the first subset of electrical contacts 552 is aligned along a straight line that is parallel to the X-coordinate axis. The second subset of electrical contacts 554 may similarly have a straight-line alignment along second connection face 220 that is parallel to the terminal end of the tapered extension. In other configurations, electrical contacts may have other suitable alignments along a connection face, such as, for example, convex, concave, or staggered alignments relative to the terminal end of the tapered extension.

In at least some configurations, each electrical contact of the set of electrical contacts 118 may be offset by the same distance from the respective terminal end of the tapered extension. In other configurations, electrical contacts located along a connection face may be offset by different distances relative to each other from the terminal end of the tapered extension and/or electrical contacts located on different connection faces may be offset by different distances relative to each other from the terminal end of the tapered extension. This may be advantageous in making a ground or power contact ahead of a signal contact, for example, in order to help limit arcing and/or electrostatic discharge events during attach and/or detach.

Thus, in the example depicted in FIGS. 5 and 6, the electronic connector includes a first set of electrical contacts on the first connection face and arranged symmetrically about the second symmetry plane. The first set of electrical contacts may include six electrical contacts, with a first electrical contact of the six electrical contacts located on a first side of the second symmetry plane and spaced apart from the second symmetry plane by a first distance, a second electrical contact of the six electrical contacts located on the first side of the second symmetry plane and spaced apart from the second symmetry plane by a second distance, a third electrical contact of the six electrical contacts located on the first side of the second symmetry plane and spaced apart from the second symmetry plane by a third distance, a fourth electrical contact of the six electrical contacts located on a second side of the second symmetry plane and spaced apart from the second symmetry plane by the third distance, a fifth electrical contact of the six electrical contacts located on the second side of the second symmetry plane and spaced apart from the second symmetry plane by the second distance, and a sixth electrical contact of the six electrical contacts located on the second side of the second symmetry plane and spaced apart from the second symmetry plane by the first distance.

The electronic connector further includes a second set of electrical contacts on the second connection face and arranged symmetrically about the second symmetry plane, the second set of electrical contacts including four electrical contacts, a first electrical contact of the four electrical contacts located on the first side of the second symmetry plane and spaced apart from the second symmetry plane by the first distance, a second electrical contact of the four electrical contacts located on the first side of the second symmetry plane and spaced apart from the second symmetry plane by the second distance, a third electrical contact of the four electrical contacts located on the second side of the second symmetry plane and spaced apart from the second symmetry plane by the second distance, and a fourth electrical contact of the four electrical contacts located on the second side of the second symmetry plane and spaced apart from the second symmetry plane by the first distance. The pitch for this implementation could match that of the USB TYPE-C, but other pitches would also be possible.

FIG. 5 depicts first flank surface 405 and second flank surface 305 tapering toward each other from base 110 to first nose 410. In one example, first flank surface 405 and second flank surface 305 taper toward each other symmetrically about second symmetry plane 330. In a symmetric configuration, a magnitude of a taper angle of first flank surface 405 is equal to a magnitude of a taper angle of second flank surface 305. In FIG. 5, taper angles are measured relative to the outward facing edge profiles of the respective flank surfaces and to respective reference axes that are parallel to both the connection axis 102 and the Z-coordinate axis. Flank surface taper angle(s) relative to second symmetry plane 330 may be the same as, greater than, or less than outer surface taper angle(s) relative to first symmetry plane 230. Flank surfaces 405 and 415 are each symmetric about first symmetry plane 230 in the depicted configuration, as are flank surfaces 305 and 315. In other implementations, flank surfaces may be nonsymmetrical.

In at least some use-scenarios, a smaller taper angle relative to the connection axis may advantageously provide greater connection depth and/or connector retention by a female connector, while a larger taper angle relative to the connection axis may advantageously reduce connector size and/or assist in connector mating with a female connector. A lesser taper angle may also allow for a relatively smaller opening in the X dimension of a corresponding female connector, thus increasing options for small device size and/or female connector placement.

In some implementations, first connection face 210 may be defined as the area of the tapered extension that houses the first subset of electrical contacts 552. As shown in FIG. 5, this area may extend between the dashed lines, and the flank surfaces 405 and 305 may comprise the area outside of the dashed lines. The area of the flank surfaces illustrated in FIG. 5 may begin to curve from the first connection face 210 toward the first outer surface at the dashed lines, or the area of the flank surfaces may be substantially parallel to the first connection face.

Likewise, second connection face 220 may be defined as the area of the tapered extension that houses the second subset of electrical contacts 554. As shown in FIG. 6, this area may extend between the dashed lines, and the flank surfaces 415 and 315 may comprise the area outside of the dashed lines. The area of the flank surfaces illustrated in FIG. 6 may begin to curve from the second connection face 220 toward the second outer surface at the dashed lines, or the area of the flank surfaces may be substantially parallel to the second connection face.

Connection faces 210 and 220, outer surfaces 205 and 215, back surface 430, flank surfaces 305, 405, 415, and 315, and noses 410 and 420 may collectively form a shell of electronic connector 100. In at least some configurations, this shell may take the form of a single integrated component formed from a common material or combination of materials. As an example, this shell may be formed (e.g., via injection molding) from a polymer. However, other suitable materials and/or manufacturing processes may be used.

First connection face 210 and second connection face 220 may define openings or windows within the shell that are occupied by electrical contacts 118. For example, first connection face 210 may define a first subset of openings or windows in the shell that are occupied by the first subset of electrical contacts 552, and second connection face 220 may define a second subset of openings or windows in the shell that are occupied by the second subset of electrical contacts 554.

Base 110 may also form part of the shell of electronic connector 100 in some configurations, and may be combined with tapered extension 112 into a single integrated component formed from a common material or combination of materials. In other configurations, base 110 may form a separate component from tapered extension 112, and may be formed from the same or different material than tapered extension 112. Base 110 may be electrically grounded, which may provide for EMI shielding and/or a path for power return as part of a power circuit.

Electrical contacts may be formed from any suitable electrically conductive material or combination of materials. Examples of electrically conductive materials include metals, such as gold, copper, silver, and aluminum. However, electrical contacts may be formed from other suitable electrically conductive materials or combinations of materials. Within the context of electronic connector 100, for example, electrical contacts may be formed from a material or combination of materials that serve as a better electrical conductor than a material or combination of materials that form first connection face 210 and second connection face 220 of tapered extension 112. First connection face 210 and second connection face 220 may be formed from any suitable material or combination of materials (e.g., a polymer) that serve as an electrical insulator between individual electrical contacts.

In at least some configurations, electronic connector 100 further includes one or more magnetically attractable elements. As one example, FIGS. 5 and 6 depict electronic connector 100 including a first magnetically attractable element 572 and a second magnetically attractable element 574 included on or within base 110. These magnetically attractable elements may be aligned with and correspond to magnetically attractable elements included on or within a corresponding electronic connector with which electronic connector 100 is configured to form an electrical connection (e.g., receptacle 910 of FIG. 9).

A magnetically attractable element may include a permanent magnet, an electromagnet, and/or a material that is attracted by another magnet. A non-limiting example of a permanent magnet includes rare earth magnets. However, other suitable permanent magnets may be used. Examples of materials that are attracted by magnets include at least some forms of steel, iron, nickel, cobalt, and certain rare earth metals. As used herein, "magnet" is used to refer to both permanent magnets and other magnetically attractable elements paired with another element that provides the magnetic attraction.

Thus, as shown, electronic connector includes a first magnet within the base and spaced a first distance from the second symmetry plane on a first side of the second symmetry plane, and a second magnet within the base and spaced the first distance from the second symmetry plane on a second side of the second symmetry plane, different than the first side of the second symmetry plane.

While electronic connector 100 is depicted as including two magnetically attractable elements, an electronic connector, such as example electronic connector 100, may include any suitable quantity of magnetically attractable elements, including one, two, three, four, or more magnetically attractable elements. When two or more magnetically attractable elements are included, individual magnetically attractable elements may be located on both sides of the second symmetry plane 330. In one example, electronic connector 100 may include four magnetically attractable elements. The additional two magnetically attractable elements may be positioned symmetrically relative to the second symmetry plane, for example aligned horizontally or vertically with magnetically attractable element 572 and second magnetically attractable element 574.

First magnetically attractable element 572 and second magnetically attractable element 574 are configured to cooperate with one or more corresponding magnetically attractable elements of a paired electronic connector to magnetically hold electronic connector 100 in place while interfacing with that paired electronic connector.

In one example, first magnetically attractable element 572 and second magnetically attractable element 574 may be located within base 110. In this example, first magnetically attractable element 572 and second magnetically attractable element 574 may be hidden behind a surface of base 110. In another example, first magnetically attractable element 572 and second magnetically attractable element 574 may be included on base 110 where they may be exposed to one or more magnetically attractable elements of a corresponding electronic connector. In this example, outward facing surfaces of first magnetically attractable element 572 and second magnetically attractable element 574 may be flush with a surface of base 110, may be recessed relative to the surface, or may protrude relative to the surface.

One or more magnetically attractable elements may alternatively or additionally be included on or within tapered extension 112. In one example, one or more magnetically attractable elements may be included on or within the first and/or second nose of tapered extension 112, including configurations in which outward facing surfaces of the magnetically attractable elements are flush with an outward surface of the nose, recessed relative to the outward surface of the nose, protrude relative to the outward surface of the nose, or are hidden behind the outward surface of the nose.

A permanent magnet or electromagnet forming a magnetically attractable element of an electronic connector may have a polarity that corresponds to or is paired with an inverse polarity or an attractable polarity of another magnet of a paired electronic connector. Magnetic polarity may be used, in at least some implementations, to enforce a particular connection orientation or preclude an incorrect connection orientation between paired electronic connectors.

As one example, first magnetically attractable element 572 may have a first polarity and second magnetically attractable element 574 may have a second polarity that differs from the first polarity. In this example, a paired electronic connector may include a corresponding magnetically attractable element having a polarity that is attracted to the first polarity of first magnetically attractable element 572 and another magnetically attractable element having a polarity that is repelled by first magnetically attractable element 572. Continuing with this example, the second polarity of second magnetically attractable element 574 may be attracted to the magnetically attractable element of the paired electronic connector that was repelled by the first magnetically attractable element 572. However, for implementations in which paired electronic connectors include two or more connection orientations (e.g., reversible connectors), first magnetically attractable element 572 and second magnetically attractable element 574 may have the same or similar polarity. In such case, the paired electronic connector may have one or more corresponding magnetically attractable elements that are each attracted to first magnetically attractable element 572 and second magnetically attractable element 574 of electronic connector 100.

As another example, a magnetically attractable element may include a spatially varying polarity (e.g., bipolar) across an outward facing surface of that magnetically attractable element. For example, magnetically attractable element 572 may include a first polarity along a first portion of its outward facing surface and a second polarity that differs from the first polarity along a second portion of its outward facing surface. Magnetically attractable element 574 may include a spatially varying polarity across its outward facing surface that is the same as or differs in orientation from magnetically attractable element 572 to provide a reversible or non-reversible electronic connector pair that includes corresponding magnetically attractable elements of the other electronic connector.

An electronic connector, such as example electronic connector 100, may be constructed using a variety of manufacturing techniques including, as non-limiting examples: plastic injection molding, inset molding, and overmolding for tapered extension and base components of the electronic connector; and metal blanking, forming, and stamping for electrical contacts, the electrical ground conductor body, and other conductive components. Manual and/or automated assembly processes may be used to combine connector components.

It will be appreciated in view of the previously described example configurations that reversibility of an electronic connector, such as example electronic connector 100, between two or more different connection orientations with a paired electronic connector may be achieved by inclusion of one or more symmetric features. Examples of symmetric features include: (1) symmetric connector geometries such as symmetric connection faces, symmetric flank surfaces, etc., (2) symmetric electrical contact arrangements, and/or (3) symmetric magnetically attractable elements about first symmetry plane 230 and/or second symmetry plane 330.

It will also be appreciated that non-reversibility of an electronic connector supporting only a single connection orientation with a paired electronic connector may be achieved by inclusion of one or more asymmetric features. These asymmetric features may be used to enforce a particular connection orientation or preclude an incorrect connection orientation between paired electronic connectors. Non-limiting examples of asymmetric features include: (1) asymmetric connector geometries such as asymmetric connection faces, asymmetric flank surfaces, etc., (2) asymmetric electrical contact arrangements, and/or (3) asymmetric magnetically attractable elements about first symmetry plane 230 and/or second symmetry plane 330.

The electronic connectors disclosed herein may take the form of multi-function electronic connectors that may be used for electronic devices. As a non-limiting example, an electronic device may take the form of a computing device, such as a tablet computer, desktop computer, notebook computer, server computer, handheld smartphone, set top box, entertainment console, and/or augmented reality head mounted display device. As other examples, an electronic device may take the form of a digital camera, graphical display device, wearable device, smart electronic appliance, or other suitable electronic device. The disclosed electronic connectors may replace or reduce the need for multiple independent connectors. In at least some configurations, the disclosed electronic connectors may serve as the only electronic connector located on or interfacing with an electronic device. In other configurations, two or more of the disclosed electronic connectors may be present on the same device. In such configurations, the device may be configured to pass power and/or data between different connected devices.

The disclosed electrical contacts have been described by example in terms of transferring electrical power, ground, and/or signals across a connector interface through physical surface contact with another electrical contact. However, in other configurations, one or more of the electronic connectors may transfer electrical power, ground, and/or signals across a connector interface without physical surface contact via induction. In such case, the interface may, for example, include an air gap and/or electrically insulating, non-conductive materials located between paired electrical contacts or other suitable inductor components that are used to exchange power, ground, and/or signals via induction. Transformers and coils, for example, may be used to facilitate transfer by induction.

The disclosed connectors have been described by example as electronic connectors having one or more electrical contacts. However, in other configurations, the disclosed connectors may instead take the form of optical connectors having one or more optical contacts or optical interfaces. For example, one or more electrical contacts of an electronic connector may instead refer to optical contacts or optical interfaces of an optical connector that are configured to exchange optical signals with corresponding optical contacts or optical interfaces of a paired optical connector. Further, connectors that utilize both electrical and optical interfaces are within the scope of this disclosure.

As explained previously, electronic connector 100 may be adapted to mate with a standard USB TYPE-C receptacle. However, in order to accommodate the tapering of the flank surfaces, insufficient space may be present on the first connection face and second connection face to provide all the electrical contacts found in a standard USB TYPE-C electronic connector. For example, a standard USB TYPE-C electronic connector includes two sets of electrical contacts, one set with twelve contacts and another set with ten contacts. To accommodate the tapering, electronic connector 100 may not include six electrical contacts for each set of electrical contacts (e.g., the outer-most three electrical contacts from each side may be left off).

In some implementations, a ground and/or power return path may be provided via one or more electrically conductive portions of the shell formed by the outer surfaces, inner connection faces, noses, and back surface of tapered extension 112. For example, first outer surface 205 and/or second outer surface 215 may be coated in an electrically-conductive material along at least a portion of each respective outer surface, such as at outward-facing corners of each outer surface. However, such a configuration may necessitate the receptacle to include current-return fingers positioned to contact the electrically-conductive coating of the outer surfaces, which may limit the receptacles into which electronic connector 100 may be inserted.

Accordingly, in one embodiment, an electronic connector may include one or more electrical contacts protruding from its back surface and configured to make electrical contact with an electrically conductive element on a surface of a corresponding receptacle, such as the exposed metal midplane of a receptacle. The electrical contacts at the back surface may be resiliently biased away from the back surface, in order to also function as detent springs, for example.

Figure 7:
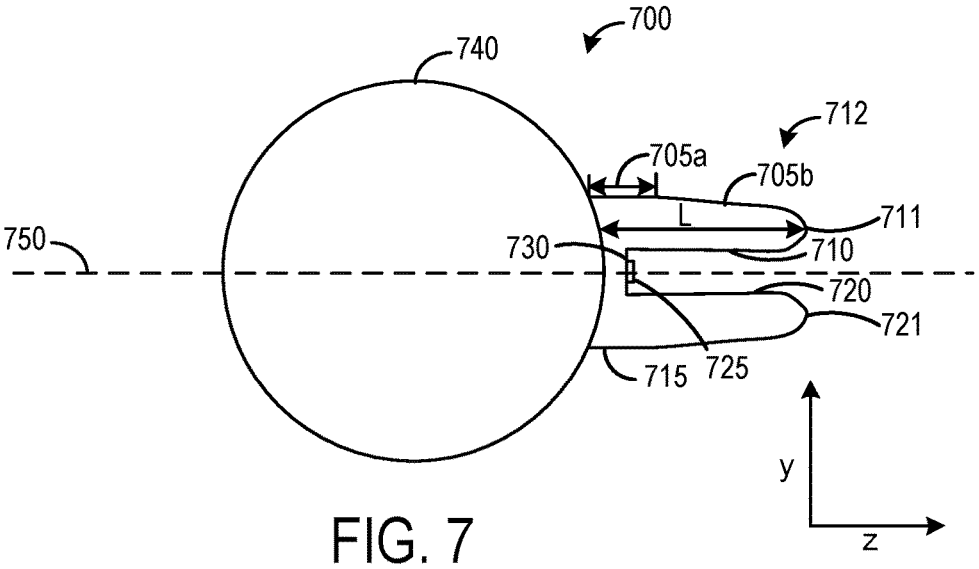
FIG. 7 is a side view of an example electronic connector having another configuration as viewed along the X-coordinate axis.

FIG. 7 illustrates an electronic connector 700 having a second configuration. Electronic connector 700 is similar to previously described electronic connector 100 in many respects with the exception of additional electrical contacts. Electronic connector 700 includes a base 740, similar to base 110 of FIG. 1, and a tapered extension 712 that is the same as tapered extension 112 of FIG. 1, and further includes one or more additional electrical contacts 725. As such, tapered extension 712 includes a first outer surface 705, second outer surface 715, first connection face 710, second connection face 720, first nose 711, second nose 721, a set of flank surfaces, and back surface 730 that collectively form a c-shaped tapered extension having an opening adapted to mate with corresponding receptacle. The first and second outer surfaces may taper inward along the length of the tapered extension toward the first and second noses symmetrically with respect to first symmetry plane 750, similar to the first and second outer surfaces of tapered extension 112 of FIG. 1. Likewise, the flank surfaces of tapered extension 712 may each taper inward toward the first and second noses with respect to a second symmetry plane, similar to the flank surfaces of tapered extension 112 of FIG. 1. While not shown in FIG. 7, a set of electrical contacts is distributed across the first and second connection faces of tapered extension 712, similar to the set of electrical contacts 118 of FIG. 1.

Figure 9:
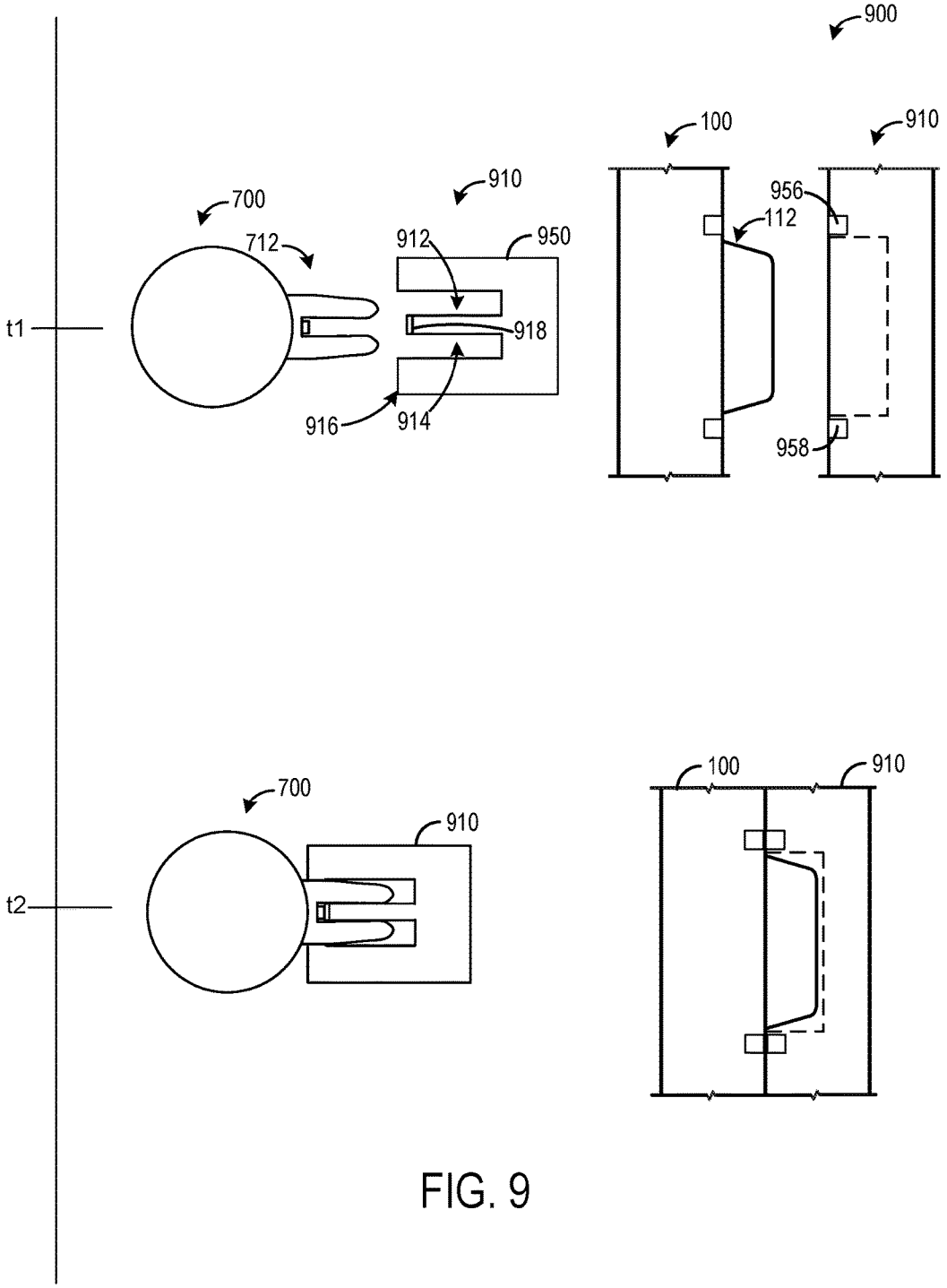
FIG. 9 depicts an example timeline of connecting the electronic connector of FIG. 1 with a corresponding receptacle.

The one or more additional electrical contacts 725 may be comprised of a suitably electrically-conductive material and may be positioned to interface with or otherwise come into electrical contact with a tongue of a corresponding receptacle, as shown in FIG. 9. As standard USB TYPE-C receptacles include electrically-conductive material at the tongue of the receptacle, current may be returned via the tongue and one or more additional electrical contacts 725. Further, the electrical contacts 725 may act as a spring to ensure tight connection between the electronic connector 700 and corresponding receptacle.

Figure 8:
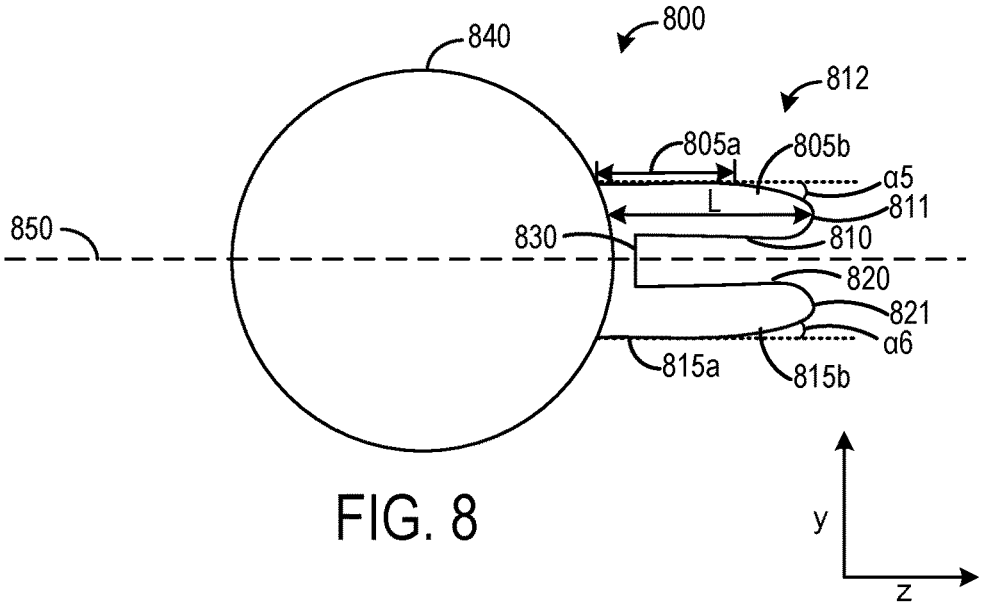
FIG. 8 is a side view of an example electronic connector having another configuration as viewed along the X-coordinate axis.

Turning to FIG. 8, an example electronic connector 800 having a third configuration is depicted. Electronic connector 800 is similar to previously described electronic connector 100 and electronic connector 700 in many respects with the exception of differences in the tapered extension geometry.

Electronic connector 800 includes a base 840, similar to base 110 of FIG. 1, and a tapered extension 812 that is the same as tapered extension 112 of FIG. 1 and tapered extension 712 of FIG. 7 with the exception of differences in the tapering geometry (described below). As such, tapered extension 812 includes a first outer surface (comprised of a non-tapering portion 805*a* and a tapering portion 805*b*), second outer surface 815, first connection face 810, second connection face 820, first nose 811, second nose 821, a set of flank surfaces, and back surface 830 that collectively form a c-shaped tapered extension having an opening adapted to mate with corresponding receptacle. The first and second outer surfaces may taper inward along the length of the tapered extension toward the first and second noses symmetrically with respect to first symmetry plane 850, similar to the first and second outer surfaces of tapered extension 112 of FIG. 1 and tapered extension 712 of FIG. 7. Likewise, the flank surfaces of tapered extension 812 may each taper inward toward the first and second noses with respect to a second symmetry plane, similar to the flank surfaces of tapered extension 112 of FIG. 1. While not shown in FIG. 8, a set of electrical contacts is distributed across the first and second connection faces of tapered extension 812, similar to the set of electrical contacts 118 of FIG. 1.

The first and second outer surfaces of tapered extension 812 may have a longer non-tapering portion than the tapered extension of FIG. 1 and FIG. 7. As shown in FIG. 8, tapered extension 812 may have a length L from the base to a respective nose (e.g., from base 840 to first nose 811). Non-tapering portion 805*a* of the first outer surface may have a length that is greater than 50% of the length of the tapered extension, as shown by the arrowed line in FIG. 8. FIG. 7 shows that tapered extension 712 (and likewise, tapered extension 112) has a length L from the base to a respective nose (e.g., from base 740 to first nose 711), which may be equal to the length of tapered extension 812. In contrast, the non-tapering portion 705*a* of the first outer surface of tapered extension 712 may have a length that is less than 50% of the length of tapered extension 712, as shown by the arrowed line in FIG. 7.

Additionally, the first outer surface and second outer surface of the tapered extension 812 may taper outward symmetrically from the respective nose to the base with a taper angle of $\alpha 5$ and $\alpha 6$, respectively. These taper angles may be equal to each other, and may also be equal to the taper angles $\alpha 1$ and $\alpha 2$ of tapered extension 112. However, in other embodiments, taper angles $\alpha 5$ and $\alpha 6$ may be different (e.g., smaller) than taper angles $\alpha 1$ and $\alpha 2$ of tapered extension 112.

Turning to FIG. 9, a timeline 900 is depicted, illustrating mating between an electronic connector and a corresponding receptacle. Specifically, FIG. 9 shows mating between electronic connector 700 and a corresponding receptacle 910, although it is to be understood that similar mating may occur between electronic connector 100 or electronic connector 800 and a corresponding receptacle. Receptacle 910 may be a standard USB TYPE-C receptacle or other suitable receptacle. Electronic connector 700 and receptacle 910 are shown along both the X-coordinate axis and the Y-coordinate axis for each of two time points, time t1 and time t2.

At time t1, electronic connector 700 has not yet been brought into contact with receptacle 910. As shown, receptacle 910 includes a connector body 950 that defines a first opening 912 and a second opening 914 that serve as a receptacle for receiving a tapered extension of a corresponding electronic connector. Tapered extension 112 of electronic connector 100, tapered extension 712 of electronic connector 700, and tapered extension 812 of electronic connector 800 are non-limiting examples. FIG. 9 depicts a side surface 916 of connector body 950 around openings 912 and 914. Side surface 916 is configured to house the openings 912 and 914.

Receptacle 910 includes a first set of electrical contacts located within opening 912 and a second set of electrical contacts located within opening 914. Each electrical contact may be configured to make contact with a corresponding electrical contact of a male electronic connector (e.g., connector 700) to establish one or more electrical connections across the connector pair. As an example, the first set of electrical contacts may include twelve electrical contacts, and the second set of electrical contacts may also include twelve electrical contacts.

At time t2, electronic connector 700 is inserted into receptacle 910, establishing connection with electrical contacts and various surfaces of electronic connector 700 and receptacle 910, as described in more detail below.

Within the context of receptacle 910 interfacing with electronic connector 700, for example, the first set of electrical contacts of the receptacle interface with the first subset of electrical contacts 552, respectively, and the second set of electrical contacts of the receptacle interface with the second subset of electrical contacts 554, respectively. In a reversible connector pair configuration, the first set of electrical contacts of the receptacle may alternatively interface with the second subset of electrical contacts 554, respectively, and the second set of electrical contacts of the receptacle may interface with the first subset of electrical contacts 552, respectively.

Receptacle 910 may further include one or more magnetically attractable elements included on or within connector body 950. For example, FIG. 9 depicts a first magnetically attractable element 956 located on a first side of opening 912 and/or opening 914 and a second magnetically attractable element 958 located on a second side of opening 912 and/or opening 914 opposite the first side. Magnetically attractable elements 956 and 958 may be aligned with and configured to attract corresponding magnetically attractable elements of example electronic connector 700.

Within the context of receptacle 910 interfacing with electronic connector 100, for example, connector body 950 may include one or more of: a first interior face that forms a floor of opening 912 and which corresponds to and/or accommodates first connection face 710 of electronic connector 700 (or second connection face 720 when electronic connector is inserted in a reversible fashion), a second interior face that forms a ceiling of opening 914 and which corresponds to and/or accommodates second connection face 720 (or first connection face 710 when electronic connector is inserted in a reversible fashion). The first interior face of receptacle 910 may, for example, include the first set of electrical contacts, and second interior face may include the second set of electrical contacts. Receptacle 910 may further include a tongue 918 that may interface with a back surface of electronic connector 700. Tongue 910 may include exposed metal or other electrically conductive material configured to make electrical contact with electrical contact 725, for example. This electrical connection may furthermore serve as the ground return path for the power delivery of the mated pair.

Receptacle 910 may further include various flank surfaces that form respective side walls of openings 912 and 914 and which correspond to and/or accommodate the flank surfaces of electronic connector 700. Receptacle 910 also includes an internal terminal end surface in each opening that corresponds to and/or accommodates each nose of electronic connector 700.

Some or all of these one or more interior surfaces or a portion thereof that forms openings 912 and 914 may contact some or all of the corresponding surfaces of a tapered extension of a male electronic connector while interfacing with that male electronic connector. Side surface 916 of receptacle 910 or a portion thereof may contact a base surface of electronic connector 700 or a portion thereof when interfacing with electronic connector 700, for example. Further, side surface 916 may be substantially straight, as shown, or may be inclined.

Further, in at least some configurations, one or more of the previously described interior surfaces of openings 912 and 914 may include or may be augmented with one or more dynamic interface elements that contact one or more surfaces of a male electronic connector. As an example, one or more dynamic interface elements may include or take the form of finger springs or leaf springs.

FIG. 10 shows a table 1000 depicting example pin-out configurations for a standard USB TYPE-C receptacle and example electronic connector 100. In FIG. 10, "Vbus" equals bus voltage, "CC" equals communication channel, "D+", "D−" equal differential data pair channels, "SBU" equals a sideband use channel, "Vconn" equals connector voltage, "TX" equals transmission channel, "RX" equals reception channel, "GND" equals ground, and "NC" equals no connector. As described above, the male electronic connector may not be configured to form an electrical connection with every electrical contact available in the female electronic connector. For example, pins 1-3, 10-15, 18, 19, 22-24 of the female electronic connector may not form an electrical connection with an electrical contact of the male electronic connector. Electrical contacts may not be present in the corresponding locations of the male electronic connector.

In some examples, an electronic connector includes a base and a tapered extension protruding from the base. The tapered extension includes a first connection face parallel with a first symmetry plane of the tapered extension, a first set of electrical contacts on the first connection face and arranged symmetrically about a second symmetry plane of the tapered extension that is orthogonal to the first symmetry plane, a second connection face parallel with the first symmetry plane of the tapered extension and facing the first connection face, a second set of electrical contacts on the second connection face and arranged symmetrically about the second symmetry plane, a first nose at an end of the first connection face distal from the base, a second nose at an end of the second connection face distal from the base, a first outer surface extending from the first nose towards the base, a second outer surface extending from the second nose towards the base, a tapering portion of the first outer surface and a tapering portion of the second outer surface tapering away from one another towards the base symmetrically about the first symmetry plane, a first flank surface between the first connection face and the first outer surface at a first side of the tapered extension, a second flank surface between the first connection face and the first outer surface at a second side of the tapered extension, a portion of the first flank surface and a portion of the second flank surface tapering away from one another towards the base symmetrically about the second symmetry plane, a third flank surface between the second connection face and the second outer surface at the first side of the tapered extension, and a fourth flank surface between the second connection face and the second outer surface at the second side of the tapered extension, a portion of the third flank surface and a portion of the fourth flank surface tapering away from one another towards the base symmetrically about the second symmetry plane. The electrical connector further includes a first magnet within the base and spaced a first distance from the second symmetry plane on a first side of the second symmetry plane and a second magnet within the base and spaced the first distance from the second symmetry plane on a second side of the second symmetry plane, different than the first side of the second symmetry plane. Such an example additionally or alternatively may include the base being connected to a power cord. Such an example additionally or alternatively may include the base being a component of a docking station. Such an example additionally or alternatively may include the first set of electrical contacts including six electrical contacts and the second set of electrical contacts including four electrical contacts. Such an example additionally or alternatively may include the first outer surface comprising a non-tapering portion intermediate the base and the tapering portion of the first outer surface, and the second outer surface comprising a non-tapering portion intermediate the base and the tapering portion of the second outer surface. Such an example additionally or alternatively may include the tapering portion of the first outer surface having a greater length than a length of the non-tapering portion of the first outer surface, and the tapering portion of the second outer surface having a greater length than a length of the non-tapering portion of the second outer surface. Such an example additionally or alternatively may include the tapering portion of the first outer surface having a smaller length than a length of the non-tapering portion of the first outer surface, and the tapering portion of the second outer surface having a smaller length than a length of the non-tapering portion of the second outer surface. Such an example additionally or alternatively may include a back surface connecting the first connection face to the second connection face. Such an example additionally or alternatively may include the first outer surface, the first nose, the first connection face, the back surface, the second connection face, the second nose, the second outer surface, the first flank surface, the second flank surface, the third flank surface, and the fourth flank surface collectively defining a c-shaped tapered extension. Such an example additionally or alternatively may include one or more electrical contacts at the back surface. Such an example additionally or alternatively may include the electrical contacts being resiliently biased away from the back surface. Such an example additionally or alternatively may include the first outer surface, the first nose, the first connection face, the second connection face, the second nose, the second outer surface, the first flank surface, the second flank surface, the third flank surface, and the fourth flank surface not being electrically conductive. Such an example additionally or alternatively may include the first nose, the first connection face, the second connection face, the second nose, the first flank surface, the second flank surface, the third flank surface, and the fourth flank surface not being electrically conductive, and at least a portion of the first outer surface and at least a portion of the second outer surface being electrically conductive. Any or all of the above-described examples may be combined in any suitable manner in various implementations.

In some examples an electronic connector includes a base and a c-shaped tapered extension protruding from the base, the c-shaped tapered extension including a top surface and a bottom surface tapering toward one another symmetrically about a first symmetry plane as the c-shaped tapered extension extends away from the base, a first side and a second side tapering toward one another symmetrically about a second symmetry plane orthogonal to the first symmetry plane as the c-shaped tapered extension extends away from the base, a first connection face, a second connection face, and a back surface collectively defining an opening of the c-shaped tapered extension, a first set of electrical contacts on the first connection face and arranged symmetrically about the second symmetry plane, and a second set of electrical contacts on the second connection face and arranged symmetrically about the second symmetry plane. The electronic connector further includes one or more magnets coupled to the base. Such an example additionally or alternatively may include the first side comprising a first flank surface between the first connection face and the first outer surface and a third flank surface between the second connection face and the second outer surface, the first flank surface and third flank surface at least partially separated by the opening; and the second side comprising a second flank surface between the first connection face and the first outer surface and a fourth flank surface between the second connection face and the second outer surface, the second flank surface and fourth flank surface at least partially separated by the opening. Such an example additionally or alternatively may include the one or more magnets comprising a first magnet within the base and spaced a first distance from the second symmetry plane on a first side of the second symmetry plane; and a second magnet within the base and spaced the first distance from the second symmetry plane on a second side of the second symmetry plane, different than the first side of the second symmetry plane. Such an example additionally or alternatively may include a back surface connecting the first connection face to the second connection face. Such an example additionally or alternatively may include one or more electrical contacts at the back surface. Such an example additionally or alternatively may include the electrical contacts being resiliently biased away from the back surface. Any or all of the above-described examples may be combined in any suitable manner in various implementations.

In some examples, an electronic connector includes a base and a c-shaped tapered extension protruding from the base, the c-shaped tapered extension including a top surface and a bottom surface tapering toward one another symmetrically about a first symmetry plane as the c-shaped tapered extension extends away from the base, a first side and a second side tapering toward one another symmetrically about a second symmetry plane orthogonal to the first symmetry plane as the c-shaped tapered extension extends away from the base, a first connection face, a second connection face, and a back surface collectively defining an opening of the c-shaped tapered extension; a first set of electrical contacts on the first connection face and arranged symmetrically about the second symmetry plane, the first set of electrical contacts including six electrical contacts, a first electrical contact of the six electrical contacts located on a first side of the second symmetry plane and spaced apart from the second symmetry plane by a first distance, a second electrical contact of the six electrical contacts located on the first side of the second symmetry plane and spaced apart from the second symmetry plane by a second distance, a third electrical contact of the six electrical contacts located on the first side of the second symmetry plane and spaced apart from the second symmetry plane by a third distance, a fourth electrical contact of the six electrical contacts located on a second side of the second symmetry plane and spaced apart from the second symmetry plane by the third distance, a fifth electrical contact of the six electrical contacts located on the second side of the second symmetry plane and spaced apart from the second symmetry plane by the second distance, and a sixth electrical contact of the six electrical contacts located on the second side of the second symmetry plane and spaced apart from the second symmetry plane by the first distance, and a second set of electrical contacts on the second connection face and arranged symmetrically about the second symmetry plane, the second set of electrical contacts including four electrical contacts, a first electrical contact of the four electrical contacts located on the first side of the second symmetry plane and spaced apart from the second symmetry plane by the first distance, a second electrical contact of the four electrical contacts located on the first side of the second symmetry plane and spaced apart from the second symmetry plane by the second distance, a third electrical contact of the four electrical contacts located on the second side of the second symmetry plane and spaced apart from the second symmetry plane by the second distance, and a fourth electrical contact of the four electrical contacts located on the second side of the second symmetry plane and spaced apart from the second symmetry plane by the first distance. The electronic connector further includes a first magnet within the base and spaced a first distance from the second symmetry plane on a first side of the second symmetry plane; and a second magnet within the base and spaced the first distance from the second symmetry plane on a second side of the second symmetry plane, different than the first side of the second symmetry plane.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. An electronic connector, comprising:

a base;

a tapered extension protruding from the base, the tapered extension including:

a first connection face parallel with a first symmetry plane of the tapered extension, a first set of electrical contacts on the first connection face and arranged symmetrically about a second symmetry plane of the tapered extension that is orthogonal to the first symmetry plane, a second connection face parallel with the first symmetry plane of the tapered extension and facing the first connection face, a second set of electrical contacts on the second connection face and arranged symmetrically about the second symmetry plane, a first nose at an end of the first connection face distal from the base;

a second nose at an end of the second connection face distal from the base, a first outer surface extending from the first nose towards the base, a second outer surface extending from the second nose towards the base, a tapering portion of the first outer surface and a tapering portion of the second outer surface tapering away from one another towards the base symmetrically about the first symmetry plane, a first flank surface between the first connection face and the first outer surface at a first side of the tapered extension, a second flank surface between the first connection face and the first outer surface at a second side of the tapered extension, a portion of the first flank surface and a portion of the second flank surface tapering away from one another towards the base symmetrically about the second symmetry plane, a third flank surface between the second connection face and the second outer surface at the first side of the tapered extension, and a fourth flank surface between the second connection face and the second outer surface at the second side of the tapered extension, a portion of the third flank surface and a portion of the fourth flank surface tapering away from one another towards the base symmetrically about the second symmetry plane;

a first magnet within the base and spaced a first distance from the second symmetry plane on a first side of the second symmetry plane; and a second magnet within the base and spaced the first distance from the second symmetry plane on a second side of the second symmetry plane, different than the first side of the second symmetry plane.

2. The electronic connector of claim 1, wherein the base is connected to a power cord.

3. The electronic connector of claim 1, wherein the base is a component of a docking station.

4. The electronic connector of claim 1, wherein the first set of electrical contacts includes six electrical contacts and the second set of electrical contacts includes four electrical contacts.

5. The electronic connector of claim 1, wherein the first outer surface comprises a non-tapering portion intermediate the base and the tapering portion of the first outer surface, and wherein the second outer surface comprises a non-tapering portion intermediate the base and the tapering portion of the second outer surface.

6. The electronic connector of claim 5, wherein the tapering portion of the first outer surface has a greater length than a length of the non-tapering portion of the first outer surface, and wherein the tapering portion of the second outer surface has a greater length than a length of the non-tapering portion of the second outer surface.

7. The electronic connector of claim 5, wherein the tapering portion of the first outer surface has a smaller length than a length of the non-tapering portion of the first outer surface, and wherein the tapering portion of the second outer surface has a smaller length than a length of the non-tapering portion of the second outer surface.

8. The electronic connector of claim 1, further comprising a back surface connecting the first connection face to the second connection face.

9. The electronic connector of claim 8, wherein the first outer surface, the first nose, the first connection face, the back surface, the second connection face, the second nose, the second outer surface, the first flank surface, the second flank surface, the third flank surface, and the fourth flank surface collectively define a c-shaped tapered extension.

10. The electronic connector of claim 8, further comprising one or more electrical contacts at the back surface.

11. The electronic connector of claim 10, wherein the electrical contacts are resiliently biased away from the back surface.

12. The electronic connector of claim 1, wherein the first outer surface, the first nose, the first connection face, the second connection face, the second nose, the second outer surface, the first flank surface, the second flank surface, the third flank surface, and the fourth flank surface are not electrically conductive.

13. The electronic connector of claim 1, wherein the first nose, the first connection face, the second connection face, the second nose, the first flank surface, the second flank surface, the third flank surface, and the fourth flank surface are not electrically conductive, and wherein at least a portion of the first outer surface and at least a portion of the second outer surface are electrically conductive.

14. An electronic connector, comprising:

a base;

a c-shaped tapered extension protruding from the base, the c-shaped tapered extension including:

a top surface and a bottom surface tapering toward one another symmetrically about a first symmetry plane as the c-shaped tapered extension extends away from the base, a first side and a second side tapering toward one another symmetrically about a second symmetry plane orthogonal to the first symmetry plane as the c-shaped tapered extension extends away from the base, a first connection face, a second connection face parallel to and facing the first connection face, and a back surface collectively defining an opening of the c-shaped tapered extension, a first set of electrical contacts on the first connection face and arranged symmetrically about the second symmetry plane, and a second set of electrical contacts on the second connection face and arranged symmetrically about the second symmetry plane; and one or more magnets coupled to the base.

15. The electronic connector of claim 14, wherein:

the first side comprises a first flank surface between the first connection face and a first outer surface and a third flank surface between the second connection face and a second outer surface, the first flank surface and third flank surface at least partially separated by the opening; and the second side comprises a second flank surface between the first connection face and the first outer surface and a fourth flank surface between the second connection face and the second outer surface, the second flank surface and fourth flank surface at least partially separated by the opening.

16. The electronic connector of claim 14, wherein the one or more magnets comprise:

a first magnet within the base and spaced a first distance from the second symmetry plane on a first side of the second symmetry plane; and a second magnet within the base and spaced the first distance from the second symmetry plane on a second side of the second symmetry plane, different than the first side of the second symmetry plane.

17. The electronic connector of claim 14, further comprising a back surface connecting the first connection face to the second connection face.

18. The electronic connector of claim 17, further comprising one or more electrical contacts at the back surface.

19. The electronic connector of claim 18, wherein the electrical contacts are resiliently biased away from the back surface.

20. An electronic connector, comprising:

a base;

a c-shaped tapered extension protruding from the base, the c-shaped tapered extension including:

a top surface and a bottom surface tapering toward one another symmetrically about a first symmetry plane as the c-shaped tapered extension extends away from the base, a first side and a second side tapering toward one another symmetrically about a second symmetry plane orthogonal to the first symmetry plane as the c-shaped tapered extension extends away from the base, a first connection face, a second connection face parallel to and facing the first connection face, and a back surface collectively defining an opening of the c-shaped tapered extension;

a first set of electrical contacts on the first connection face and arranged symmetrically about the second symmetry plane, the first set of electrical contacts including six electrical contacts, a first electrical contact of the six electrical contacts located on a first side of the second symmetry plane and spaced apart from the second symmetry plane by a first distance, a second electrical contact of the six electrical contacts located on the first side of the second symmetry plane and spaced apart from the second symmetry plane by a second distance, a third electrical contact of the six electrical contacts located on the first side of the second symmetry plane and spaced apart from the second symmetry plane by a third distance, a fourth electrical contact of the six electrical contacts located on a second side of the second symmetry plane and spaced apart from the second symmetry plane by the third distance, a fifth electrical contact of the six electrical contacts located on the second side of the second symmetry plane and spaced apart from the second symmetry plane by the second distance, and a sixth electrical contact of the six electrical contacts located on the second side of the second symmetry plane and spaced apart from the second symmetry plane by the first distance, and a second set of electrical contacts on the second connection face and arranged symmetrically about the second symmetry plane, the second set of electrical contacts including four electrical contacts, a first electrical contact of the four electrical contacts located on the first side of the second symmetry plane and spaced apart from the second symmetry plane by the first distance, a second electrical contact of the four electrical contacts located on the first side of the second symmetry plane and spaced apart from the second symmetry plane by the second distance, a third electrical contact of the four electrical contacts located on the second side of the second symmetry plane and spaced apart from the second symmetry plane by the second distance, and a fourth electrical contact of the four electrical contacts located on the second side of the second symmetry plane and spaced apart from the second symmetry plane by the first distance;

a first magnet within the base and spaced a first distance from the second symmetry plane on a first side of the second symmetry plane; and a second magnet within the base and spaced the first distance from the second symmetry plane on a second side of the second symmetry plane, different than the first side of the second symmetry plane.

* * * * *